US011781227B2

(12) United States Patent
Purdy et al.

(10) Patent No.: US 11,781,227 B2
(45) Date of Patent: Oct. 10, 2023

(54) COMPOSITION USEFUL IN METAL SULFIDE SCALE REMOVAL

(71) Applicant: FLUID ENERGY GROUP LTD., Calgary (CA)

(72) Inventors: Clay Purdy, Medicine Hat (CA); Markus Weissenberger, Calgary (CA); Adrienne Lee, Calgary (CA)

(73) Assignee: DORF KETAL CHEMICALS FZE, Fujairah (AE)

( * ) Notice: Subject to any disclaimer, the term of this patent is extended or adjusted under 35 U.S.C. 154(b) by 152 days.

(21) Appl. No.: 17/060,283

(22) Filed: Oct. 1, 2020

(65) Prior Publication Data

US 2021/0102300 A1 Apr. 8, 2021

(30) Foreign Application Priority Data

Oct. 2, 2019 (CA) ..... CA 3057217

(51) Int. Cl.
*C23G 1/19* (2006.01)
*C23G 1/18* (2006.01)

(52) U.S. Cl.
CPC ..... *C23G 1/19* (2013.01); *C23G 1/18* (2013.01)

(58) Field of Classification Search
CPC ... C23G 1/14; C23G 1/18; C23G 1/19; C23G 1/22; C02F 1/50; C02F 1/683; C02F 2101/101; C02F 2103/34; C02F 2303/08; C02F 2305/00
See application file for complete search history.

(56) References Cited

U.S. PATENT DOCUMENTS 3,627,687 A * 12/1971 Teumac ..... C11D 11/0029 510/480
4,220,550 A * 9/1980 Frenier ..... C23G 1/02 510/505
4,371,443 A * 2/1983 Keeney ..... C09K 8/72 507/224
4,680,127 A * 7/1987 Edmondson ..... C02F 1/20 422/5
5,152,916 A * 10/1992 Hoffmann ..... B01D 53/1493 252/387
5,223,175 A * 6/1993 Mabire ..... B01D 53/1493 252/189
5,284,635 A * 2/1994 Frederic ..... C10G 29/24 208/240
6,068,056 A * 5/2000 Frenier ..... C09K 8/86 507/202
6,086,056 A 6/2000 Leask et al.
6,365,053 B1 4/2002 Sunde et al.
6,582,624 B2 6/2003 Titley et al.
9,260,669 B2 * 2/2016 Ramachandran ..... C10G 19/02
9,783,728 B2 * 10/2017 Mahmoud ..... E21B 37/06
9,938,470 B2 * 4/2018 Yang ..... C10G 29/22
10,815,415 B2 * 10/2020 Chen ..... C09K 8/532
11,084,971 B2 * 8/2021 Belakshe ..... C09K 8/532
2004/0045875 A1 * 3/2004 Nguyen ..... B01D 17/047 208/251 R
2007/0221246 A1 * 9/2007 Keatch ..... C09K 8/528 134/41
2011/0155646 A1 6/2011 Karas et al.
2013/0274155 A1 * 10/2013 Nasr-El-Din ..... C09K 8/54 507/241
2014/0090663 A1 * 4/2014 Woo ..... C11D 3/2079 134/28
2014/0287968 A1 * 9/2014 Reyes ..... C09K 8/528 507/241
2018/0072936 A1 3/2018 Sehsah et al.
2018/0148632 A1 * 5/2018 Bennett ..... C23F 11/161

FOREIGN PATENT DOCUMENTS

WO WO-9915012 A1 * 4/1999 ..... A01N 35/02

OTHER PUBLICATIONS

Disch, WO-9915012-A1, Machine Translation. (Year: 2023).*

* cited by examiner

*Primary Examiner* — Duy Vu N Deo
*Assistant Examiner* — Christopher Remavege
(74) *Attorney, Agent, or Firm* — Blank Rome LLP

(57) ABSTRACT

The present invention discloses a method and a composition for removing metal sulfide scale present on the surface of a metal, said method comprising:

providing a liquid composition comprising:

a chelating agent and a counterion component selected from the group consisting of: sodium gluconate; gluconic acid; tetrasodium EDTA; EDTA; propylenediaminetetraacetic acid (PDTA); nitrilotriacetic acid (NTA); N-(2-hydroxyethyl) ethylenediaminetriacetic acid (HEDTA); diethylenetriaminepentaacetic acid (DTPA); hydroxyethyliminodiacetic acid (HEIDA); cyclohexylenediaminetetraacetic acid (CDTA); diphenylaminesulfonic acid (DPAS); ethylenediaminedi(o-hydroxyphenylacetic) acid (EDDHA); glucoheptonic acid; gluconic acid; oxalic acid; malonic acid; succinic acid; glutaric acid; adipic acid; pimelic acid; suberic acid; azelaic acid; sebacic acid; phthalic acid; terephthalic acid; aconitic acid; carballylic acid; trimesic acid; isocitric acid; citric acid; L-glutamic acid-N,N-diacetic acid (GLDA); salts thereof; and mixtures thereof; and an aldehyde; and water exposing a surface contaminated with said metal sulfide scale to the liquid composition;

allowing sufficient time of exposure to remove said metal sulfide scale from the contaminated surface and sequestration of the sulfur ions from solution.

20 Claims, No Drawings

COMPOSITION USEFUL IN METAL SULFIDE SCALE REMOVAL

CROSS REFERENCE TO RELATED APPLICATION

This application claims priority Canada patent application number 3,057,217 filed Oct. 2, 2019, the entire contents of which are incorporated by reference herein.

FIELD OF THE INVENTION

The present invention is directed to a composition and method for use in oilfield and industrial operations, more specifically to compositions used in the removal of metal sulfide scale.

BACKGROUND OF THE INVENTION

Scaling, or the formation of sulfide mineral deposits can occur on surfaces of metal, rock or other materials. Scale is caused by a precipitation process as a result of thermodynamic and hydrodynamic factors or changes in pressure, velocity rates and temperature and the subsequent change in the composition of a solution (commonly water).

Metal sulfide scale, particularly iron sulfide scale, is problematic in the oil and gas industry and the most common method for removing such is by exposure to an acidic solution, typically hydrochloric acid. While an acid treatment such as the one mentioned above is generally successful in removing metal sulfide scale, the major drawback of such an approach is the release of the sulfide ions from the metal sulfide, ions which then combine with hydrogen protons to form hydrogen sulfide. Hydrogen sulfide is a very dangerous gas which is highly corrosive and toxic. The presence of hydrogen sulfide gas on a worksite, or anywhere close to settlements, is extremely undesirable and should be avoided as much as possible.

During the production, transport or further treatment of hydrocarbons, concentrations of hydrogen sulfide may vary greatly but it nevertheless presents a number of various challenges which include human and animal health and environmental risks and major corrosion of midstream and downstream assets of great value. The presence of hydrogen sulfide often forces operators to increase their operational investments as it requires added expense with regard to materials handling and transport equipment. The presence of hydrogen sulfide may also lead to an additional refinement requirement and expenses associated therewith.

In many cases, these scale deposits restrict or even shut-off the production conduit if the produced water composition flow dynamics are interrupted by changes in pressure and/or temperature. In many cases this is due to upstream or midstream components, such as chokes, safety valves, piping layouts, flow-controls etc. In addition to produced formation brine water scaling issues due to the mineral content, also other sourced water utilized in well workover or completions operations can be potential sources of scaling minerals, including water flood operations or geothermal operations as well as being commonly observed in processing operations.

The formation of metal sulfide scale (such as iron sulfide scale) is more common in midstream and downstream, i.e. in the pipelines and in the refineries. The removal of this scale in such locations using the conventional methods exposes workers to dangerous conditions from the common generation of hydrogen sulfide gas, and thus while the operation is necessary, it does present safety challenges and thus additional costs for operators.

The following patents and patent applications discuss various approaches to removing hydrogen sulfide gas from hydrocarbons.

U.S. Pat. No. 6,582,624 A1 method and composition for reducing the levels of hydrogen sulfide and mercaptans in hydrocarbon streams. The method comprises contacting the gas stream with a composition comprising the reaction product of mixing monoethanolamine, diglycolamine and formaldehyde. The use of the method and composition alleviates problems associated with crystalline dithiazine deposit build-up associated with the use of triazine based scavengers.

US Patent application no. 2011/0155646 discloses a method for reducing the amount of hydrogen sulfide present in crude oil includes adding a hydrogen sulfide scavenger composition to the crude oil to capture the hydrogen sulfide, migrating the captured sulfides to an aqueous phase and removing the aqueous phase from the crude oil. The hydrogen sulfide scavenger composition includes glyoxal and a quaternary ammonium salt.

U.S. Pat. No. 6,086,056 teaches an acidic fluid that is useful in stimulation and workover operations, and in particular, in matrix acidizing treatments, comprises an acid, such as hydrochloric acid; water; an aliphatic aldehyde having 1-10 carbon atoms; and an aromatic aldehyde having 7-20 carbon atoms. The aliphatic aldehyde preferably has 1-6 carbon atoms. Glyoxylic acid and glyoxal are especially preferred aliphatic aldehydes. The aromatic aldehyde preferably has 7-10 carbon atoms. Cinnamaldehyde is especially preferred.

US Patent application No. 2018/0072936 discloses a method comprising the steps of mixing an amount of scavenger into a drilling mud to produce a scavenger-containing drilling mud such that the scavenger-containing drilling mud has a scavenging capacity, wherein the drilling mud is at a target pH, and introducing the scavenger-containing drilling mud into the wellbore during drilling operations, where the scavenger-containing drilling mud is operable to work with a drill bit to drill the wellbore, where the amount of scavenger in the scavenger-containing drilling mud is operable to irreversibly react with hydrogen sulfide present in the drilling mud to produce a scavenged hydrogen sulfide.

U.S. Pat. No. 6,365,053 teaches a method for removing hydrogen sulfide in drilling mud comprises adding to the drilling mud which is circulated in a borehole a relatively sparingly soluble divalent iron salt having a solubility from 0.1 to 1000 ppm at room temperature in the drilling mud, whereby the hydrogen sulfide reacts with the divalent iron salt to form iron sulfide.

US Patent application No. 2018/0072936 discloses a method for removing hydrogen sulfide from fluids such as oil and gas well drilling, treatment, and production fluids and effluents from hydrocarbon operations and mineral mining operations. The sulfide scavenger used in the method is a gluconate salt other than ferrous gluconate. The gluconate salt is added to the fluid along with an iron source if iron is not already in the fluid. The gluconate reacts with the iron and forms iron gluconate in the fluid, which in turn reacts with the hydrogen sulfate to form iron sulfide which may be readily removed from the fluid.

As is the case with many difficult to remediate problems, it is acknowledged that the best method to deal with iron sulfide scale is to avoid its formation in the first place. Scale inhibitor injection treatments have shown some tendency to minimize the formation of iron sulfide scale. However, once present, the conventionally accepted method of removing such is by acid washes with appropriate additives to control corrosion and other unintended consequences. It is common to treat difficult deposits of iron sulfide scale which have low solubility in acidic media, with mechanical means, increasing the costs for the operator.

Despite the existing prior art, there is no known method of removing metal sulfide scale without the negative effect of generating hydrogen sulfide gas as a byproduct. It is highly advantageous to industry to have a chemical option that can accomplish the efficient removal of metal (such as iron) sulfide scale without acidic based treatments which have significant drawbacks. There thus still exists a profound need for compositions and methods capable of removing metal sulfide scale (such as iron sulfide scale) without the generation of hydrogen sulfide gas.

SUMMARY OF THE INVENTION

According to a first aspect of the present invention, there is provided an aqueous composition for use in removing metal sulfide scale present on a contaminated surface, said method comprising:

providing a liquid composition comprising:

a chelating agent and a counterion component selected from the group consisting of: sodium gluconate; gluconic acid; tetrasodium EDTA; EDTA; propylenediaminetetraacetic acid (PDTA); nitrilotriacetic acid (NTA); N-(2-hydroxyethyl) ethylenediaminetriacetic acid (HEDTA); diethylenetriaminepentaacetic acid (DTPA); hydroxyethyliminodiacetic acid (HEIDA); cyclohexylenediaminetetraacetic acid (CDTA); diphenylaminesulfonic acid (DPAS); ethylenediaminedi(o-hydroxyphenylacetic) acid (EDDHA); glucoheptonic acid; gluconic acid; oxalic acid; malonic acid; succinic acid; glutaric acid; adipic acid; pimelic acid; suberic acid; azelaic acid; sebacic acid; phthalic acid; terephthalic acid; aconitic acid; carballylic acid; trimesic acid; isocitric acid; citric acid; L-glutamic acid-N,N-diacetic acid (GLDA); salts thereof; and mixtures thereof; and an aldehyde;

exposing a surface contaminated with said ferrous sulfide scale to the liquid composition;

allowing sufficient time of exposure to remove said metal sulfide scale from the contaminated surface.

According to a preferred embodiment of the present invention, the aldehyde is selected from the group consisting of: glyoxal; glyoxylic acid; 2-butenal; 3-methyl-2-butenal; trans-2-methyl-2-butenal; 3,7-dimethylocta-2,6-dienal; benzaldehyde; cinnamaldehyde and combinations thereof.

As mentioned previously, it is important that such compositions as they are mainly directed at surface treatment (mid-stream and downstream) and not downhole operations, avoid the generation of sulfide gas as much as possible as this is highly toxic and dangerous to workers in close proximity of such gas. According to the present invention, preferred compositions achieve the removal of sulfide from the dissolution of metal sulfide scale and hence allow for substantially safe metal sulfide dissolution from various mid-stream and downstream equipment.

According to another aspect of the present invention, there is provided an aqueous composition for use in removing ferrous sulfide scale from a surface contaminated with such, said composition comprising:

a chelating agent and a counterion component selected from the group consisting of: sodium gluconate; gluconic acid; tetrasodium EDTA; EDTA; propylenediaminetetraacetic acid (PDTA); nitrilotriacetic acid (NTA); N-(2-hydroxyethyl) ethylenediaminetriacetic acid (HEDTA); diethylenetriaminepentaacetic acid (DTPA); hydroxyethyliminodiacetic acid (HEIDA); cyclohexylenediaminetetraacetic acid (CDTA); diphenylaminesulfonic acid (DPAS); ethylenediaminedi(o-hydroxyphenylacetic) acid (EDDHA); glucoheptonic acid; gluconic acid; oxalic acid; malonic acid; succinic acid; glutaric acid; adipic acid; pimelic acid; suberic acid; azelaic acid; sebacic acid; phthalic acid; terephthalic acid; aconitic acid; carballylic acid; trimesic acid; isocitric acid; citric acid; L-glutamic acid-N,N-diacetic acid (GLDA); salts thereof; and mixtures thereof; and an aldehyde.

According to a preferred embodiment of the present invention, the chelating agent and counterion is $Na_4EDTA$.

According to another preferred embodiment of the present invention, the chelating agent and counterion is L-glutamic acid-N,N-diacetic acid (GLDA)

According to a preferred embodiment of the present invention, the aldehyde is present in the composition in an amount ranging from 20 to 70 wt % of the weight of the composition. Preferably, the aldehyde is present in the composition in an amount ranging from 25 to 50 wt % of the weight of the composition.

According to a preferred embodiment of the present invention, the chelating agent is present in the composition in an amount ranging from 20 to 70 wt % of the weight of the composition.

According to a preferred embodiment of the present invention, the aldehyde is present in the composition in an amount ranging from 40 to 60 wt % of the weight of the composition.

According to a preferred embodiment of the present invention, the chelating agent is present in the composition in an amount ranging from 40 to 60 wt % of the weight of the composition.

According to a preferred embodiment of the present invention, the chelating agent and the aldehyde are present in the composition in an amount of approximately 50 wt % of the weight of the composition.

According to a preferred embodiment of the present invention, the chelating agent and the aldehyde are present in the composition in an amount of approximately 40 wt % of the weight of the composition.

Preferably, the pH of the composition ranges from 8 to 10. Preferably, the pH of the composition is 8.7.

According to a preferred embodiment of the present invention, the aldehyde can be selected from the group consisting of: aliphatic aldehyde having 1-10 carbon atoms; and aromatic aldehyde having 7-20 carbon atoms. According to a preferred embodiment of the present invention, the aliphatic aldehyde preferably has 1-6 carbon atoms. According to an embodiment of the present invention, the aldehyde can be selected from the group consisting of: acrolein; crotonaldehyde and formaldehyde, and combinations thereof. Glyoxylic acid and glyoxal are especially preferred aliphatic aldehydes. According to a preferred embodiment of the present invention, the aromatic aldehyde preferably has 7-10 carbon atoms. Benzaldehyde and cinnamaldehyde are especially preferred.

According to a preferred embodiment of the present invention, the method can further comprise a step of disposal of the spent chelating agents and/or of the aldehyde having sequestered the sulfur ions. The composition according to a preferred embodiment of the present invention exhibit at least one advantageous feature insofar as it can remove lead sulfide scale without releasing hydrogen sulfide and all the while sequestering isotopes of lead which are radioactive. This is a substantial advantage over the conventional approach to metal sulfide scale removal.

DETAILED DESCRIPTION OF A PREFERRED EMBODIMENT

According to a preferred embodiment of the present invention, the metal sulfide scale removing composition provides excellent scale dissolution combined with the sequestration of sulfide ions. This, in turn, reduces the down time for producing wells or facilities where the scale is being removed and the associated costs of removal or lost production. It also reduces the cost of such treatment, by limiting the treatment apparatus required, as well as substantially increasing the safety of individuals involved in scale removal operations by considerably reducing the presence of free sulfate ions and consequently limiting the risk of the formation of hydrogen sulfide gas during the scale removal operations.

According to a preferred embodiment of the present invention, a composition for removing iron sulfide scale permits the removal thereof with a high dissolution capacity. This, in turn, allows reducing the volume of scale remover necessary. This also decreases transport costs and many other related items resulting from the usage of lower volumes of scale remover.

EXAMPLE 1

Process to Prepare a Composition According to a Preferred Embodiment of the Invention To prepare a 40 wt % $Na_4EDTA$ solution formulation, one must first weigh 400 g of $Na_4EDTA$, the one dilutes up to 1000 mL with distilled water. To prepare a metal sulfide dissolver solution formulation, one pours 40 mL of 40 wt % $Na_4EDTA$ solution into a graduated cylinder, then one adds 40 mL of 40 wt % glyoxal in water solution. Then, the resulting mixture is diluted up to 100 mL with water. Table 1 provides the physical properties of the composition of Example 1.

TABLE 1

Physical properties of a composition of Example 1 according to a preferred embodiment of the present invention

| | Metal sulfide dissolver solution of Example 1 |
|---|---|
| Appearance | clear, amber |
| Specific Gravity | 1.183 |
| pH @ ° C. | 8.71 @ 21.0° C. |
| Refractive Index | 1.3849 |
| Freezing point | −12° C. |

EXAMPLE 2

Another composition according to a preferred embodiment of the present invention was prepared. This one contained 40 mL of 40 wt % $Na_4EDTA$ solution into a graduated cylinder, then one adds 25 mL of 40 wt % Glyoxal in water solution. 0.75% of a corrosion inhibitor was incorporated in the composition. The corrosion inhibitor was Basocorr PP® commercially available. Table 2 provides the physical properties of the composition of Example 2.

TABLE 2

Physical properties of a composition of Example 2 according to a preferred embodiment of the present invention

| | Metal sulfide dissolver solution of Example 2 |
|---|---|
| Appearance | clear, amber |
| Specific Gravity | 1.156 |
| pH @ ° C. | 9.27 @ 22.6° C. |
| Refractive Index | 1.3777 |

Alcohols and derivatives thereof, such as alkyne alcohols and derivatives and preferably propargyl alcohol and derivatives thereof can also be used as corrosion inhibitor as alternative to Basocorr PP®. Propargyl alcohol itself is traditionally used as a corrosion inhibitor which works extremely well at low concentrations. It is a toxic/flammable chemical to handle as a concentrate, so care must be taken during handling the concentrate. In the composition according to the present invention, the toxic effect does not negatively impact the safety of the composition.

Corrosion Testing

The composition of Example 1 was placed in contact with various metal coupons in order to assess its corrosiveness to metals. The coupons were exposed at a temperature of 55° C. for a duration of 168 hours. The results of this corrosion testing are set out in Table 4 below. The duration of the experiment is done to reflect the chelation reaction which occurs when such a metal scale dissolver is used as it is a slow reaction which does not occur substantially faster at elevated temperatures.

TABLE 4

Corrosion testing on composition of Example 1 various coupons at 55° C., for an exposure of 168 hours and 0 psi pressure

| Temp (° C.) | Coupon | Hours | Corrosion ($lb/ft^2$) | Pits |
|---|---|---|---|---|
| 55 | 316SS | 168 | 0.000 | No |
| 55 | A7075-T6 | 168 | 0.004 | No |

Solubilizing Iron Sulfide

The inventors have previously noted that chelating agents such as EDTA (Ethylenediaminetetraacetic acid) or DTPA (diethylenetriaminepentaacetic acid) have the ability to dissolve deposited metal sulfides such as iron sulfide. To be effective EDTA and the like must be put in solution at around pH 9. According to a preferred embodiment, the pH is around 8.7.

The incumbent chemical treatment to remove iron sulfide scale typically utilizes acid to dissolve the scale. As the scale removal process is typically carried out at a low pH, (due to the acid present to remove the scale), the sulfide ions which are released from the scale go back into solution, subsequently forming hydrogen sulfide gas. The generation of hydrogen sulfide ($H_2S$) is an unwanted and serious problem for operators as it is a fatal toxic gas and highly corrosive thus causing further damage to facilities or wellbore tubulars. The value of the present invention lies in allowing the removal of metal sulfide scale (such as iron sulfide) yielding far safer conditions than the conventional process and thus minimizing the treatment costs.

Moreover, the compositions according to the present invention, provide an advantageous environmental safety profile compared to the other chemical methods used to dissolve metal sulfide scale. This represents a major advantage over those previous methods mentioned. Another advantage to the compositions, according to preferred embodiments of the present invention, include the handling of the composition as well as the disposal of the solution effluent post-scale removal.

In terms of metal sulfide scale, one notes there are several scales which can cause problems, leading to potential operational and/or production deficiencies. These include: zinc sulfide, lead sulfide, iron sulfide, and calcium sulfide. The most common form of metal sulfide scale that would be encountered on oilfield equipment or processing facilities is iron sulfide. However, zinc sulfide scale may be present in smaller amounts and is quite difficult to remove. Alternatively lead sulfide scale can be removed somewhat more easily than zinc sulfide but presents different challenges. There are at least 7 known isotopes which are radioactive, three of them have half-lives between 22.3 and 17.3 million years. $^{202}Pb$ and $^{205}Pb$ are gamma emitter and $^{210}Pb$ is a beta emitter. All those isotopes can be a source of natural occurring radioactive material (NORM) and it is advantageous to remove such safely from contaminated surfaces or tools. Having the present invention safely and efficiently remove lead sulfide scale by chelating the lead atoms and sequestrating the sulfur atoms is desirable.

Dissolution Testing

To assess the effectiveness of the compositions according to preferred embodiments of the present invention, metal scale dissolution testing was carried out. Table 5 compiles the results of the tests of the dissolving power of various compositions according to preferred embodiments of the present invention when performed at 60° C. (140° F.).

TABLE 5

Results of the dissolution of FeS by various compositions at 60° C. (140° F.) carried out in a solution of 100 mL

| 40 wt % $Na_4EDTA$ soln (v %) (mL) | 40 wt % Sodium Gluconate (v %) | 40 wt % Glyoxal (v %) (mL) | Wt of Iron(II) Sulfide (g) | Wt of filter (g) | Final wt of sample and filter (g) | Wt loss (g) | Total solubility (kg/m3) |
|---|---|---|---|---|---|---|---|
| 20 | | 20 | 4.9991 | 0.2773 | 3.7532 | 1.5232 | 15.232 |
| 20 | | 40 | 5.0024 | 0.2920 | 3.6348 | 1.6596 | 16.596 |
| 30 | | 30 | 5.0006 | 0.2827 | 3.0019 | 2.2814 | 22.814 |
| 30 | | 70 | 3.9918 | 0.2867 | 3.3242 | 0.9543 | 9.543 |
| 40 | | 20 | 5.0039 | 0.2867 | 2.8746 | 2.4160 | 24.160 |
| 40 | | 40 | 5.0020 | 0.2959 | 2.1636 | 3.1343 | 31.343 |
| 40 | | 40 | 3.9987 | 0.2679 | 1.1792 | 3.0874 | 30.874 |
| 40 | | 60 | 4.0016 | 0.2808 | 1.0096 | 3.2728 | 32.728 |
| 50 | | 50 | 5.0009 | 0.2801 | 1.3556 | 3.9254 | 39.254 |
| 60 | | 40 | 4.0002 | 0.2616 | 0.8768 | 3.3850 | 33.850 |
| 70 | | 30 | 4.0096 | 0.2792 | 3.0643 | 1.2245 | 12.245 |
| | 60 | 40 | 5.0027 | 0.2821 | 4.0723 | 1.2125 | 12.125 |
| | 50 | 50 | 5.0020 | 0.2651 | 4.1699 | 1.0972 | 10.972 |
| | 40 | 60 | 5.0001 | 0.2783 | 4.3061 | 0.9723 | 9.723 |

Visual observation of the reactions revealed that no hydrogen sulfide gas was generated during the experiments. This is an indication that the composition used to dissolve the iron sulfide was not an acidic composition and the dissolution (removal) of the metal sulfide scale did not generate hydrogen sulfide gas as conventional acid based treatments do. The results indicate that preferred compositions according to the present invention provide a volume % of chelating and aldehyde in roughly the same amounts. The testing also illustrates that excellent total solubility was obtained for most all of the compositions tested, all the while generating no hydrogen sulfide gas.

Moreover, pH of the resulting solution was measured in order to assess the resulting mixture. The measured pH was in the range of pH 3.5 to 4.5.

To assess the effectiveness of a composition according to preferred embodiments of the present invention on the dissolution of various metal sulfide scale testing was carried out on various metals and with various components missing from said composition. Table 6 compiles the results of the tests.

TABLE 6

Results of the dissolution of various sulfide scales with various compositions at 60° C. (140° F.) carried out in a solution of 100 mL

| Sample | 40 wt % $Na_4EDTA$ soln (v %) (mL) | 40 wt % Glyoxal (v %) (mL) | Wt of Iron(II) Sulfide (g) | Wt of filter (g) | Final wt of sample and filter (g) | Wt loss (g) | Total solubility (kg/m3) |
|---|---|---|---|---|---|---|---|
| ZnS | 40 | 40 | 3.9989 | 28.4005 | 32.0780 | 0.3214 | 3.214 |
| PbS | 40 | 40 | 6.9981 | 28.4394 | 29.9678 | 5.4697 | 54.697 |

TABLE 6-continued

Results of the dissolution of various sulfide scales with various compositions at 60° C. (140° F.) carried out in a solution of 100 mL

| Sample | 40 wt % $Na_4EDTA$ soln (v %) (mL) | 40 wt % Glyoxal (v %) (mL) | Wt of Iron(II) Sulfide (g) | Wt of filter (g) | Final wt of sample and filter (g) | Wt loss (g) | Total solubility (kg/m3) |
|---|---|---|---|---|---|---|---|
| FeS | | 40 | 4.0017 | 28.4135 | 31.8816 | 0.5336 | 5.336 |
| FeS | 40 | | 3.9989 | 28.4244 | 32.4432 | −0.0199 | −0.199 |
| FeS | 40 | 40 | 5.0020 | 0.2959 | 2.1636 | 3.1343 | 31.343 |
| FeS | 40 | 40 | 3.9987 | 0.2679 | 1.1792 | 3.0874 | 30.874 |

The above results are indicative that the selected composition according to a preferred embodiment of the present invention can be used to dissolve a wide variety of metal sulfide scales. As well, it seems that the absence of either the aldehyde component or the chelating agent component causes the compositions to lose a substantial amount of their effectiveness in removing sulfide metals.

Further to the above testing and to assess the effectiveness of a composition according to preferred embodiments of the present invention on the dissolution of various metal sulfide scale under various operating conditions, testing was carried out on various metals and under various real-world scenarios. Some of these scenarios include the present of oil on the scale present on mid-stream and downstream equipment, which typically causes a substantial decrease in the effectiveness of a metal sulfide scale dissolver, Table 7 compiles the results of this series of tests.

TABLE 7

Results of the dissolution of various sulfide scales with various compositions at 60° C. (140° F.) carried out in a solution of 100 mL

| Sample | 40% $Na_4EDTA$ soln (v %) (mL) | Glyoxal (v %) (mL) | Total sample solubility ($kg/m^3$) |
|---|---|---|---|
| FeS with 10 wt % Oil | 50 | 50 | 37.797 |
| FeS with 10 wt % Oil | 40 | 40 | 35.632 |
| FeS with 10 wt % Oil | 40 | 40 | 32.392 |
| 1# Separator Khurmala FeS* | 60 | 40 | 15.140 |
| 1# Separator Khurmala FeS | 40 | 40 | 13.142 |
| 2# HE KAR FeS** | 40 | 40 | 141.730 |
| FeS | 40 | 40 | 32.243 |
| FeS | 40 | 40 | 26.870 |
| FeS | 40 | 40 | 30.839 |
| FeS | 40 | 40 | 29.482 |
| FeS | 40 | 30 | 30.350 |
| FeS | 50 | 30 | 32.637 |
| FeS | 40 | 10 | 9.958 |
| FeS | 60 | 20 | 14.315 |
| FeS | 80 | 10 | 9.864 |
| FeS | 40 | 10 | 12.801 |
| FeS | 40 | 25 | 28.166 |

TABLE 7-continued

Results of the dissolution of various sulfide scales with various compositions at 60° C. (140° F.) carried out in a solution of 100 mL

| Sample | 40% $Na_4EDTA$ soln (v %) (mL) | Glyoxal (v %) (mL) | Total sample solubility ($kg/m^3$) |
|---|---|---|---|
| PbS | 40 | 25 | 39.945 |
| ZnS | 40 | 25 | 1.455 |

Note:
CI-1A is 10 wt % potassium iodide in water.
CI-4a is a commercially available corrosion inhibitor component, Basocorr PP ®.
*refers to a refinery sample of metal sulfide scale contaminated with oil where the sample is a viscous paste
**refers to a refinery sample of metal sulfide scale contaminated with oil where the sample is flowable The data collected indicates that a preferred embodiment of the scale dissolving composition according to the present invention can be applied in a variety of conditions and achieve desirable outcomes. This confirms that such compositions have substantial value in the oil and gas industry to overcome substantial problems heretofore not adequately addressed.

It has also been established that such compositions would have value when used in geothermal applications where fluids are circulated deep into the earth and back up to the surface and may encounter similar scaling issues where metal sulfide scale may form on the walls of the tubing of these systems.

As understood by the person skilled in the art, the corrosion inhibitor used in geothermal systems may vary from those used in oil and gas activities as to be adapted to the different conditions encountered in such systems.

Corrosion Testing

The following corrosion testing outlined in the tables below for different compositions (including or excluding corrosion inhibition packages) according to the present invention at temperatures reaching 60° C. This would be representative of the conditions surface fluids (pipelines and refinery, or other surface equipment) would be subjected to. Various temperatures and various periods of exposure times were tested. A desirable result was one where the $lb/ft^2$ corrosion number is at or below 0.05. More preferably, that number is at or below 0.02. The acidic compositions also referred to as fluid or fluid systems, were also tested at various dilution ratios where 100% represents the undiluted fluid. All dilutions are done with tap water unless indicated otherwise. The results of the corrosion testing are reported in Table 8 below. Additional corrosion testing was carried out on another series of steels and the corrosion testing results are reported in Table 9.

TABLE 8

Corrosion testing of the Composition of Example #2 on various steels at various temperatures and times of exposure

| Coupon | Temp. (° C.) | Time (Hrs) | CI Package | Surface Area ($cm^2$) | Density ($g/cm^3$) | mils/year | mm/year | $lb/ft^2$ |
|---|---|---|---|---|---|---|---|---|
| 1018CS | 55 | 168 | N/A | 34.710 | 7.86 | 439.012 | 11.151 | 0.343 |
| 316 | 55 | 168 | N/A | 20.968 | 7.92 | −0.025 | −0.001 | 0.000 |
| A7075 | 55 | 168 | N/A | 32.064 | 2.81 | 15.880 | 0.403 | 0.004 |
| 1018CS | 60 | 24 | N/A | 34.710 | 7.86 | 1454.347 | 36.940 | 0.162 |
| 1018CS | 60 | 24 | Spent | 34.710 | 7.86 | 1711.390 | 43.469 | 0.191 |
| 1018CS | 60 | 48 | N/A | 34.710 | 7.86 | 1376.629 | 34.966 | 0.307 |
| 1018CS | 60 | 48 | Spent | 34.710 | 7.86 | 1022.220 | 25.964 | 0.228 |
| 1018CS | 60 | 24 | 0.75% CI-4A, 0.45% CI-1A | 34.710 | 7.86 | 657.303 | 16.696 | 0.073 |
| 1018CS | 60 | 24 | 0.75% CI-4A | 34.710 | 7.86 | 674.580 | 17.134 | 0.075 |
| 1018CS | 60 | 16 | 0.75% CI-4A | 34.710 | 7.86 | 478.558 | 12.155 | 0.036 |
| 1018CS | 40 | 24 | 0.75% CI-4A | 34.710 | 7.86 | 58.625 | 1.489 | 0.007 |
| J55 | 60 | 16 | 0.75% CI-4A | 30.129 | 7.86 | 472.400 | 11.999 | 0.035 |
| P110 | 60 | 16 | 0.75% CI-4A | 34.839 | 7.86 | 262.756 | 6.674 | 0.020 |
| QT-900 | 60 | 16 | 0.75% CI-4A | 34.774 | 7.86 | 350.544 | 8.904 | 0.026 |
| J55 | 40 | 24 | 0.75% CI-4A | 30.129 | 7.86 | 63.472 | 1.612 | 0.007 |
| P110 | 40 | 24 | 0.75% CI-4A | 34.839 | 7.86 | 48.437 | 1.230 | 0.005 |
| QT-900 | 40 | 24 | 0.75% CI-4A | 34.774 | 7.86 | 69.084 | 1.755 | 0.008 |
| 1018CS | 60 | 16 | 0.75% CI-4A, SPENT | 34.710 | 7.86 | 285.934 | 7.263 | 0.021 |
| 1018CS | 40 | 24 | 0.75% CI-4A, SPENT | 34.710 | 7.86 | 222.016 | 5.639 | 0.025 |
| 1018CS | 60 | 24 | 0.75% CI-4A, SPENT | 34.710 | 7.86 | 183.301 | 4.656 | 0.020 |
| API | 60 | 16 | 0.75% CI-4A | 33.097 | 7.86 | 415.043 | 10.542 | 0.031 |
| API | 40 | 24 | 0.75% CI-4A | 33.097 | 7.86 | 135.227 | 3.435 | 0.015 |
| API | 60 | 16 | SPENT 0.75% CI-4A | 33.097 | 7.86 | 384.634 | 9.770 | 0.029 |
| API | 40 | 24 | SPENT 0.75% CI-4A | 33.097 | 7.86 | 209.634 | 5.325 | 0.023 |

Note:

CI-1A is 10 wt % potassium iodide in water.

TABLE 9

Corrosion testing of the Composition of Example #2 on various steels at various temperatures and times of exposure at atmospheric pressure

| Coupon | CI | Temperature | | Duration | Corrosion Rate | | Pitting |
|---|---|---|---|---|---|---|---|
| Type | Package | (° C.) | (° F.) | (hrs) | mm/year | $lb/ft^2$ | Index |
| Nitronic 50 | CI-4A | 55 | 131 | 168 | 0.004 | 0.000 | 0 |
| Brass C26000 | CI-4A | 55 | 131 | 168 | 0.009 | 0.000 | 0 |
| Copper | CI-4A | 55 | 131 | 168 | 0.000 | 0.000 | 0 |
| SD 2507 | CI-4A | 55 | 131 | 168 | 0.015 | 0.000 | 0 |
| Chrome barrel | CI-4A | 55 | 131 | 168 | 8.121* | 0.0229* | 0 |
| 1018CS | CI-4 | 60 | 140 | 24 | 5.314 | 0.023 | 3 |
| J55 | CI-4 | 60 | 140 | 24 | 10.472 | 0.046 | 3 |
| P110 | CI-4 | 60 | 140 | 24 | 12.130 | 0.053 | 3 |

Note:

CI-4a is a commercially available corrosion inhibitor component, Basocorr PP ®.

CI-4 is a commercially available corrosion inhibitor component, Basocorr PA ®.

*The Chrome portion of the chrome coupon didn't show significant corrosion however the corrosion was evident on the back of the coupon.

Elastomer Compatibility

When common sealing elements used in the oil and gas industry come in contact with acid compositions they tend to degrade or at least show sign of damage. A number of sealing elements common to activities in this industry were exposed to a composition according to a preferred embodiment of the present invention to evaluate the impact of the latter on their integrity. More specifically, the hardening and drying and the loss of mechanical integrity of sealing elements can have substantial consequences on the efficiency of certain processes as breakdowns require the replacement of defective sealing elements. Testing was carried out to assess the impact of the exposure of composition of Example 2 to various elastomers. Long term (72 hour exposure) elastomer testing on the concentrated product of Example 2 at 70° C. showed little to no degradation of various elastomers, including Nitrile® 70, Viton® 75, EPDM E70® style sealing elements, the results are reported in Tables 10, 11 and 12. The results indicates that the composition of Example 2 is compatible with various elastomers typically found in the oil and gas industry.

TABLE 10

Elastomer compatibility data of the exposure of various elastomers to the composition of Example #2 for a duration of 3 days (72 hours) at 70° C.

| Elastomer | Weight before/g | Weight after/g | Weight Change/g | Weight Change/% | Thickness before/mm | Thickness after/mm | Thickness Change/mm | Thickness Change/% |
|---|---|---|---|---|---|---|---|---|
| Viton V75 240 | 0.2688 | 0.2716 | −0.0028 | −1.04 | 3.55 | 3.58 | −0.03 | −0.85 |
| Nitrile N70 240 | 0.1909 | 0.1939 | −0.0030 | −1.57 | 3.53 | 3.54 | −0.01 | −0.28 |
| EPDM E70 126 | 0.0989 | 0.1004 | −0.0015 | −1.52 | 2.59 | 2.59 | 0.00 | 0.00 |

TABLE 11

Elastomer compatibility data of the exposure of various elastomers to the composition of Example #2 for a duration of 28 days at 20° C.

| Elastomer | Weight before/g | Weight after/g | Weight Change/g | Weight Change/% | Thickness before/mm | Thickness after/mm | Thickness Change/mm | Thickness Change/% |
|---|---|---|---|---|---|---|---|---|
| Viton V75 240 | 0.2482 | 0.2485 | −0.0003 | −0.12 | 3.58 | 3.56 | 0.02 | 0.56 |
| Nitrile N70 240 | 0.1875 | 0.1883 | −0.0008 | −0.43 | 3.52 | 3.49 | 0.03 | 0.85 |
| EPDM E70 126 | 0.0998 | 0.1002 | −0.0004 | −0.40 | 2.61 | 2.60 | 0.01 | 0.38 |

TABLE 12

Elastomer compatibility data of the exposure of various elastomers to the composition of Example #2 for a duration of 3 days at 20° C.

| Elastomer | Weight before/g | Weight after/g | Weight Change/g | Weight Change/% | Thickness before/mm | Thickness after/mm | Thickness Change/mm | Thickness Change/% |
|---|---|---|---|---|---|---|---|---|
| Viton V75 240 | 0.2839 | 0.2845 | −0.0006 | −0.21 | 3.56 | 3.57 | −0.01 | −0.28 |
| Nitrile N70 240 | 0.1789 | 0.1798 | −0.0009 | −0.50 | 3.5 | 3.5 | 0.00 | 0.00 |
| EPDM E70 126 | 0.0877 | 0.0880 | −0.0003 | −0.34 | 2.6 | 2.61 | −0.01 | −0.38 |

While the foregoing invention has been described in some detail for purposes of clarity and understanding, it will be appreciated by those skilled in the relevant arts, once they have been made familiar with this disclosure that various changes in form and detail can be made without departing from the true scope of the invention in the appended claims.

The invention claimed is:

1. An aqueous composition for use in removing metal sulfide scale from a surface contaminated with the metal sulfide scale, said aqueous composition comprising:

a chelating agent selected from the group consisting of sodium gluconate; gluconic acid; tetrasodium ethylenediaminetetraacetic acid (EDTA); EDTA; propylenediaminetetraacetic acid (PDTA); nitrilotriacetic acid (NTA); N-(2-hydroxyethyl)ethylenediaminetriacetic acid (HEDTA); diethylenetriaminepentaacetic acid (DTPA); hydroxyethyliminodiacetic acid (HEIDA); cyclohexylenediaminetetraacetic acid (CDTA); diphenylaminesulfonic acid (DPAS); ethylenediaminedi(o-hydroxyphenylacetic) acid (EDDHA); glucoheptonic acid; oxalic acid; malonic acid; succinic acid; glutaric acid; adipic acid; pimelic acid; suberic acid; azelaic acid; sebacic acid; phthalic acid; terephthalic acid; aconitic acid; carballylic acid; trimesic acid; isocitric acid; citric acid; L-glutamic acid-N,N-diacetic acid (GLDA); salts thereof; and mixtures thereof;

an aldehyde; and water, wherein the aqueous composition has a pH ranging from 8 to 10, and the aldehyde is present in the aqueous composition in an amount ranging from 20 to 70 wt % of the weight of the aqueous composition.

2. The aqueous composition according to claim 1, wherein the chelating agent is present in the composition in an amount ranging from 20 to 70 wt % of the weight of the composition.

3. The aqueous composition according to claim 1, wherein the aldehyde is present in the composition in an amount ranging from 40 to 60 wt % of the weight of the composition.

4. The aqueous composition according to claim 1, wherein the chelating agent is present in the composition in an amount ranging from 40 to 60 wt % of the weight of the composition.

5. The aqueous composition according to claim 1, wherein the chelating agent and the aldehyde are present in the composition in an amount of approximately 50 wt % of the weight of the composition.

6. The aqueous composition according to claim 1, wherein the metal sulfide scale is selected from the group consisting of iron sulfide, zinc sulfide, lead sulfide, and combinations thereof.

7. The aqueous composition according to claim 1, wherein the metal sulfide scale is iron sulfide.

8. The aqueous composition according to claim 1, wherein the aldehyde is selected from the group consisting of aliphatic aldehydes having 1-10 carbon atoms and aromatic aldehydes having 7-20 carbon atoms.

9. The aqueous composition according to claim 1, wherein the aldehyde is an aliphatic aldehyde having 1-6 carbon atoms.

10. The aqueous composition according to claim 1, wherein the aldehyde is selected from the group consisting of glyoxylic acid and glyoxal.

11. The aqueous composition according to claim 1, wherein the aldehyde is selected from the group consisting of benzaldehyde and cinnamaldehyde.

12. A one-step metal sulfide scale removal process, comprising subjecting a metal sulfide scale to an aqueous composition having a pH ranging from 8 to 10 and comprising a chelating agent and glyoxal, wherein the chelating agent is selected from the group consisting of sodium gluconate; gluconic acid; tetrasodium ethylenediaminetetraacetic acid (EDTA); EDTA; propylenediaminetetraacetic acid (PDTA); nitrilotriacetic acid (NTA); N-(2-hydroxyethyl)ethylenediaminetriacetic acid (HEDTA); diethylenetriaminepentaacetic acid (DTPA); hydroxyethyliminodiacetic acid (HEIDA); cyclohexylenediaminetetraacetic acid (CDTA); diphenylaminesulfonic acid (DPAS); ethylenediaminedi(o-hydroxyphenylacetic) acid (EDDHA); glucoheptonic acid; oxalic acid; malonic acid; succinic acid; glutaric acid; adipic acid; pimelic acid; suberic acid; azelaic acid; sebacic acid; phthalic acid; terephthalic acid; aconitic acid; carballylic acid; trimesic acid; isocitric acid; citric acid; L-glutamic acid-N,N-diacetic acid (GLDA); salts thereof; and mixtures thereof;

glyoxal is present in the aqueous composition in an amount ranging from 20 to 70 wt % of the weight of the aqueous composition, and sulfide ions generated by the removal process are sequestered by said glyoxal.

13. The process of claim 12, wherein the metal sulfide scale is selected from the group consisting of: iron sulfide, zinc sulfide, lead sulfide, and combinations thereof.

14. The process of claim 12, wherein the metal sulfide scale is iron sulfide.

15. A method of removing metal sulfide scale present on a metal surface, said method comprising:

providing an aqueous composition having a pH ranging from 8 to 10 and comprising:

a chelating agent selected from the group consisting of sodium gluconate; gluconic acid; tetrasodium ethylenediaminetetraacetic acid (EDTA); EDTA; propylenediaminetetraacetic acid (PDTA); nitrilotriacetic acid (NTA); N-(2-hydroxyethyl)ethylenediaminetriacetic acid (HEDTA); diethylenetriaminepentaacetic acid (DTPA); hydroxyethyliminodiacetic acid (HEIDA); cyclohexylenediaminetetraacetic acid (CDTA); diphenylaminesulfonic acid (DPAS); ethylenediaminedi(o-hydroxyphenylacetic) acid (EDDHA); glucoheptonic acid; oxalic acid; malonic acid; succinic acid; glutaric acid; adipic acid; pimelic acid; suberic acid; azelaic acid; sebacic acid; phthalic acid; terephthalic acid; aconitic acid; carballylic acid; trimesic acid; isocitric acid; citric acid; L-glutamic acid-N,N-diacetic acid (GLDA); salts thereof; and mixtures thereof; and an aldehyde, wherein the aldehyde is present in the aqueous composition in an amount ranging from 20 to 70 wt % of the weight of the aqueous composition;

exposing a surface contaminated with said metal sulfide scale to the aqueous composition;

allowing sufficient time of exposure to remove said metal sulfide scale from the contaminated surface and sequester sulfur ions generated by removal of metal ions from the scale.

16. The method according to claim 15, wherein the aldehyde is selected from the group consisting of glyoxal, glyoxylic acid, benzaldehyde, cinnamaldehyde, and combinations thereof.

17. The method according to claim 15, further comprising a step of disposal of the chelating agent and/or of the aldehyde having sequestered the sulfur ions.

18. The aqueous composition according to claim 1, wherein the chelating agent is tetrasodium ethylenediaminetetraacetic acid.

19. The process according to claim 12, wherein the chelating agent is tetrasodium ethylenediaminetetraacetic acid.

20. The method according to claim 15, wherein the chelating agent is tetrasodium ethylenediaminetetraacetic acid.

* * * * *